United States Patent [19]

Higaki et al.

[11] Patent Number: 4,886,612

[45] Date of Patent: Dec. 12, 1989

[54] LUBRICATING OIL

[75] Inventors: Yuzo Higaki; Hiroyuki Goto; Keiichi Tanikawa, all of Kanagawa, Japan

[73] Assignees: The Nisshin Oil Mills, Ltd.; Nippon Steel Corporation, both of Tokyo, Japan

[21] Appl. No.: 225,047

[22] Filed: Jul. 27, 1988

[30] Foreign Application Priority Data

Jul. 31, 1987 [JP] Japan ..... 62-190143
Jul. 31, 1987 [JP] Japan ..... 62-190144

[51] Int. Cl.[4] ..... C10M 133/38; C10M 133/46

[52] U.S. Cl. ..... 252/49.5; 252/51.5 R; 252/51.5 A

[58] Field of Search ..... 252/51.5 R, 51.5 A, 252/49.5

[56] References Cited

U.S. PATENT DOCUMENTS

| | | | |
|---|---|---|---|
| 2,713,582 | 7/1955 | Smith | 252/51.5 R |
| 2,713,583 | 7/1955 | Smith | 252/51.5 R |
| 4,277,353 | 7/1981 | Deen et al. | 252/51.5 R |
| 4,282,108 | 8/1981 | Deen et al. | 252/51.5 R |
| 4,288,361 | 9/1981 | Zestermann et al. | 252/51.5 R |
| 4,375,417 | 3/1983 | Zoleski et al. | 252/51.5 R |
| 4,386,001 | 5/1983 | Zoleski et al. | 252/51.5 R |
| 4,392,968 | 7/1983 | Ishida et al. | 252/51.5 R |
| 4,478,732 | 10/1984 | Horodysky et al. | 252/51.5 R |
| 4,483,777 | 11/1984 | Shim | 252/51.5 R |
| 4,486,326 | 12/1984 | Gutierrez et al. | 252/51.5 R |
| 4,702,854 | 10/1987 | Snyder, Jr. et al. | 252/51.5 R |

*Primary Examiner*—William R. Dixon, Jr.
*Assistant Examiner*—E. McAvoy
*Attorney, Agent, or Firm*—Kane, Dalsimer, Sullivan, Kurucz, Levy, Eisele and Richard

[57] ABSTRACT

A lubricating oil exhibiting superior specific features particularly for metal plastic processing is provided, which lubricating oil comprises at least one member selected from the group consisting of compounds expressed by the formulas I, II, III, IV or V:

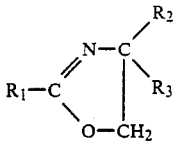

I wherein $R_1$ is alkyl, alkenyl, hydroxyalkyl, hydroxyalkenyl or phenyl and $R_2$ and $R_3$ each are $CH_2OCOR_1$, $CH_2OH$ or H wherein $R_1$ is above;

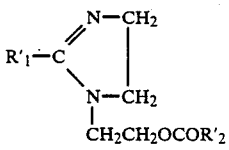

II

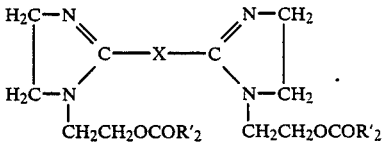

III

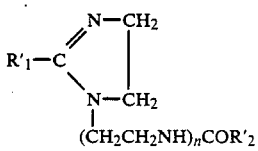

IV

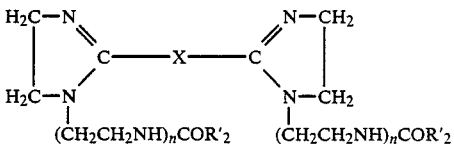

V wherein $R'_1$ and $R'_2$ each are alkyl, alkenyl, hydroxyalkyl, hydroxyalkenyl or phenyl, n is an integer of 1–3 and X is alkyl, alkenyl or phenyl.

2 Claims, No Drawings

LUBRICATING OIL

BACKGROUND OF THE INVENTION

1. Field of the Invention

This invention relates to an oxazoline compound, an imidazoline ester and an imidazoline acid amide compound having superior lubricating properties. More particularly it relates to a lubricating oil agent exhibiting superior specific features at the time of metal plastic processings such as cold rolling processing, cutting processing, draw processing, press processing, etc. of metals and at the time of spinning of synthetic fibers.

2. Description of the Related Art

In recent years, the use conditions of lubricating oils have come to be severe accompanying a rapid development of various mechanical industries and hence superior lubricating specific features have come to be required for the oils.

Cold rolling oils used for thin steel sheets are roughly classified into those containing animal or plant oils and fats such as beef tallow, lard, rape oil, palm oil, coconut oil, etc. As the base oil thereof and those containing mineral oils as the base oil thereof. In recent years, high-speed rolling, high pressure rolling and mill clean rolling have been desired accompanying energy saving and improvement in the production efficiency. Rolling oils using animal or plant oils and fats as the base oil thereof are suitable for a high-load or high-speed rolling, but if a steel sheet subjected to cold rolling is directly annealed without degreasing oil matters adhered onto the steel sheet, stains occur on the surface of the steel sheet during its annealing step. In short, the above-mentioned rolling oils are superior in the lubricating properties, but unsuitable in the mill cleanability.

On the other hand, in the case where rolling oils using mineral oils as the base oil thereof are used for cold rolling, even if a cold thin steel sheet is directly annealed, no surface stain occurs; hence the oils are superior in the mill cleanability, but deficient in the high-load or high-speed rolling properties.

In general, in the case where rolling oils using mineral oils as the base oil thereof are used, an oiliness improver has been added thereto and the resulting blend has been used in order to enhance the lubricating properties for rolling; such oiliness improvers being as animal or plant oils and fats, fatty acids e.g. capric acid, lauric acid, myristic acid, stearic acid, oleic acid, linoleac acid, etc., or synthetic esters such as monoesters, diesters or polyol esters of trimethylolpropane, pentaerythritol, 2-ethylhexylalcohol, etc., as described in Oil Chemistry, '73, November, p. 695–706, but the quantity of the foregoing compounds added has been adjusted to a narrow range in order to retain the mill cleanability. Thus, various researches on cold rolling oils which can satisfy both the high lubricating properties and the high mill-cleanability have been carried but (e.g. Japanese Patent Application Laid-open Nos. Sho 56-135600 and Sho 59-80498), but at present, such oils have not yet been found.

On the other hand, lubricants used for metal-cutting processing or metal-grinding processing have been composed by suitably mixing mineral oils, animal or plant oils and fats, high-pressure additives, surfactants, anti-foaming agents, metal rust proof agents, antioxidants, antiseptics, antifungal agents, etc. depending on the use. Cutting lubricants have usually been used by diluting them with water to 10 to 100 times, but water-insoluble cutting lubricants have also been used in same cases.

The fundamental conditions of cutting or grinding oils to be furnished with are lubricating properties, cooling properties, rust proof properties and other incidental conditions such as those deficient in foaming properties, hand-roughening properties, toxicity to men and beasts, smells, etc. Although cutting or grinding oils are varied in the manner of giving weight, on what properties they should be furnished with, depending on their uses and conditions, they should be furnished with the above-mentioned properties in a well-balanced manner. However, conventional cutting or grinding oils could not have satisfied the above-mentioned conditions.

SUMMARY OF THE INVENTION

An object of the present invention is to provide a synthetic lubricating oil having a molecular structure designed so as to afford superior lubricating characteristics when the use conditions of lubricating oils have come to be severe in recent years.

Another object of the present invention is to provide a synthetic lubricant which has high lubricating properties and a high stability and is difficultly deteriorated due to microorganisms and difficultly putrefies.

Still another object of the present invention is to provide a cold rolling oil for steel which contributes to improvement in the production efficiency such as energy saving, step saving, etc.; is stable to heat or mechanical shear generated at a high speed or under a high pressure; is also stable to chemical reactions such as oxidation, decomposition, polymerization, etc.; and yields no thermal decomposition residue and does not easily volatize at the annealing step; hence has both of the surface cleanability of steel sheets (mill cleanability) and high lubricating properties.

Further still another object of the present invention is to provide a cutting or grinding oil which has superior lubricating properties, cooling properties and rust proof properties; raises no problem of toxicity to men and beasts; and difficultly putrefies.

The present invention resides in a lubricating oil comprising at least one member selected from the group consisting of compounds expressed by the following formulas I, II, III, IV or V:

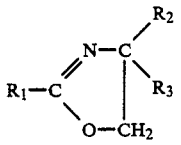

I wherein $R_1$ represents an alkyl group, an alkenyl group, a hydroxyalkyl group, a hydroxyalkenyl group each of 5 or more carbon atoms or a phenyl group; $R_2$ and $R_3$ each represent $CH_2OCOR_1$, $CH_2OH$ or H wherein $R_1$ is as defined above;

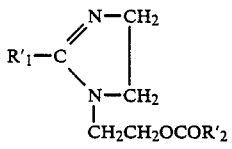

II

-continued

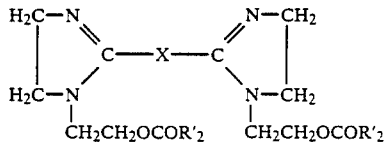

III

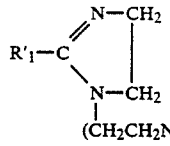

IV

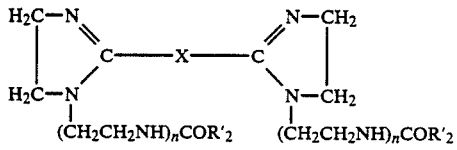

V wherein $R'_1$ and $R'_2$ each represent an alkyl group, an alkenyl group, a hydroxyalkyl group, a hydroxyalkenyl group each of 5 or more carbon atoms or a phenyl group; n represents an integer of 1 to 3; and X represents an alkyl group, an alkenyl group each of 2 to 34 carbon atoms or a phenyl group.

DETAILED DESCRIPTION OF THE INVENTION

Lubricating oils referred to herein mean those which are broadly usable for various uses such as metal plastic processing oils e.g. cutting oil, grinding oil, draw processing oil, press processing oil, rolling oil, etc., mechanical lubricating oils, etc. Cold rolling oils for steels composed mainly of synthetic oils of the present invention have such superior characteristics that they have high lubricating properties and high mill cleanability; they make it possible to carry out rolling of thin steel sheets and directly anneal the resulting materials without degreasing them; furher they have lubricating properties, cooling properties and rust proof properties as cutting oil or grinding oil; and no problem is raised on hand-roughening properties, toxicity to men and beasts, smell, etc.

The oxazolines of the above formula (I) may generally be prepared by subjecting monoethanolamine, 2-methyl-2-amino-1,3-propanediol or 2-amino-2-hydroxymethyl-1,3-propanediol and a monocarboxylic acid to dehydration-condensation and cyclization reactions.

Examples of the monocarboxylic acid used in the above preparation are saturated fatty acids, unsaturated fatty acids, hydroxyfatty acids, synthetic, branched chain fatty acids each of 6 or more carbon atoms and aromatic carboxylic acids such as benzoic acid, salicylic acid, etc.

As the fatty acids, those of 6 to 30 carbon atoms are preferred such as hexanoic acid, octanoic acid, decanoic acid, lauric acid, myristic acid, palmitic acid, stearic acid, arachic acid, behenic acid, montanic acid, palmitooleic acid, oleic acid, erucic acid, ricinolic acid, hydroxystearic acid, linolic acid, linoleic acid, isooctylic acid, isodecanoic acid, isolauric acid, isomyristic acid, isopalmitic acid, isostearic acid, isoarachic acid, etc. Further, natural fatty acids such as lanolin fatty acids, fish oil fatty acids, soybean oil fatty acids, coconut fatty acids, beef tallow fatty acids, hydrogenated fatty acids of the foregoing, etc. may also be used. The reason why the carbon atom number of the fatty acids is limited to 6 or more, is that if synthetic oils the raw materials of which are fatty acids having a carbon atom number less than 6 are used, the extent of improving the objective lubricating properties is small. On the other hand, the upper limit of the carbon atom number of the fatty acids has no particular limitation, but the preferred range of the carbon atom number of the fatty acids is 30 or less since cheap fatty acids are commercially available within such a range.

The imidazoline ester compounds expressed by the above-mentioned formula (II) may generally be obtained by subjecting N-aminoethylethanolamine and a monocarboxylic acid to dehydration-condensation reaction.

The bisimidazoline ester compounds expressed by the above-mentioned formula (III) may be obtained by subjecting a dibasic acid of 4 to 36 carbon atoms and N-aminoethylethanolamine to dehydration-condensation and cyclization reactions and then subjecting the resulting hydroxybisimidazoline and a monocarboxylic acid to esterification reaction.

The imidazoline acid amide compounds expressed by the above-mentioned formula (IV) may be obtained by subjecting a polyethylenepolyamine selected from among ethylenediamine, diethyltriamine, triethylenetetramine and tetraethylenepentamine and a monocarboxylic acid to dehydration-condensation and cyclization reactions.

The bisimidazoline acid amide compounds expressed by the above-mentioned formula (V) may be obtained by subjecting a dibasic acid of 4 to 36 carbon atoms and a polyethylenepolyamine to dehydration-condensation and cyclization reaction and then subjecting the resulting aminoethylbisimidazoline and a monocarboxylic acid to amidization reaction.

As the monocarboxylic acid used in the above-mentioned preparation, the above-mentioned saturated fatty acids, unsaturated fatty acids, hydroxyfatty acids, synthetic, branched chain fatty acids each of 6 or more carbon atoms or aromatic carboxylic acids may be used.

As the dibasic acid, dibasic fatty acids of 4 to 36 carbon atoms such as succinic acid, maleic acid, fumaric acid, adipic acid, azelaic acid, sebacic acid, dodecanediacid, brassylic acid, eicosadiacid, dimer acids, etc. and phthalic acid are commercially cheaply available.

Further, the reason that the n value of the amidized products in the formulas (IV) and (V) is limited to 1 to 3 is that if the n value exceeds 4, compounds having such values are difficult to be commercially available; hence they are unfavorable for the lubricating oils of the present invention.

The synthetic oils of the present invention may also be singly used for rolling oils, lubricating oils for metal plastic processings such as cutting, grinding or draw processing oils, lubricating oils for internal combustion engine, spinning lubricants for synthetic fibers. Further, the synthetic oils may be used in admixture with other base oils such as mineral oils, animal or plant oils or existing synthetic esters generally used. Further, an emulsifier may be added thereto depending on the objects and used in the form of an emulsion. Further, the synthetic oils may also be used in combination with emulsifiers, fatty acids, antioxidants, corrosion-resistant agents, antiseptics, antifungal agents, etc. conventionally used as additives to practical lubricating oils.

When the synthetic oils of the present invention are used in admixture with other base oils, etc., addition thereof in one % by weight or more, preferably 20% by weight or more stabilizes the specific features thereof.

Next, preparation examples of the oxazoline compounds, imidazoline ester compounds and imidazoline acid amide compounds will be described below.

Preparation example 1 (a compound of the formula (I))

Into a four-necked flask equipped with a stirrer, aa thermometer, a nitrogen gas-blowing-in tube and a water separator were fed isostearic acid (Emersol 871, tradename of a product made by Emery Industry Incorporated) (2.8 mols) and 2-amino-2-hydroxymethyl-1,3-propanediol (one mol), followed by reacting these materials under a xylene solvent reflux at 180° to 260° C. until a calculated quantity of water was distilled off. The time required therefor was 9 hours. After completion of the reaction, xylene was distilled off, followed by decolorizing the residue with white clay and filtering off the white clay to obtain the objective reaction product (Sample No. A) (821 g).

Preparation example 2 (compounds of the formula (I))

In the same manner as in Preparation example 1, into a four-necked flask were fed lanolin fatty acids (2 mols) and 2-methyl-2-amino-1,3-propanediol (2 mols), followed by reacting these materials under xylene solvent reflux at 180° to 260° C. until a calculated quantity of water was distilled off. The time required therefor was 7 hours. After completion of the reaction, xylene was distilled off, followed by decolorizing the residue with white clay and filtering off the white clay to obtain the objective reaction product (Sample number B) (712 g). Oxazoline compounds (Sample Nos. C and D) prepared in the same manner as above are shown in Table 1.

TABLE 1

Oxazoline synthetic lubricant

| Sample No. | $R_1$ | $R_2$ | $R_3$ | Hue (G) | Viscosity (cps 150° C.) | Acid value |
|---|---|---|---|---|---|---|
| A | Isostearic acid alkyl residual group | Same as the left | Same as the left | 6 | 51 | 2.1 |
| B | Lanolin fatty acid alkyl residual group | H | $CH_2OH$ | 8 | 98 | 1.2 |
| C | Isooctylic acid alkyl residual group | Beef tallow fatty acid alkyl residual group | Same as the left | 6 | 72 | 3.3 |
| D | 12-Hydroxystearic acid alkyl residual group | H | H | 5 | 69 | 1.8 |

Preparation example 3 (a compound of the formula (II))

Into a four-necked flask equipped with a stirrer, a thermometer, a nitrogen gas-blowing-in tube and a water separator were fed coconut oil fatty acids (4 mols) and N-aminoethylethanolamine (2 mols), followed by reacting these materials under xylene solvent reflux at 180° to 240° C. until a calculated quantity of water was distilled off. The time required therefor was 7 hours. After completion of the reaction, xylene was distilled off, followed by decolorizing the residue with white clay and filtering off the white clay to obtain the objective reaction product (sample No. E) (820 g).

Preparation example 4 (a compound of the formula (III))

In the same manner as in Preparation example 3, into a four-necked flask were fed adipic acid (1.5 mol) and N-aminoethylethanolamine (3 mols), followed by reacting these materials under xylene solvent reflux at 180° to 240° C. until a calculated quantity of water was distilled off. The time required therefor was 8 hours, Oleic acid (2.9 mols) was then fed, followed by carrying out reaction at 180° to 230° C. for 5 hours until a calculated quantity of water was distilled off, followed by distilling off xylene, decolorizing the residue with white clay and filtering off the white clay to obtain the objective reaction product (Sample No. H) (1.060 g).

Preparation example 5 (a compound of the formula (IV))

In the same manner as in Preparation example 3, into a four-necked flask were fed isostearic acid (Emersol 871; product made by Emery Industry Incorporated) (1.5 mol) and diethylenetriamine (1.8 mol), followed by reacting these materials under xylene solvent reflux at 180° to 260° C. until a calculated quantity of water was distilled off. The time required was 7 hours. After completion of the reaction, xylene and unreacted diethylenetriamine were distilled off under reduced pressure, followed by feeding benzoic acid (1.5 mol) and carrying out reaction under xylene solvent reflux at 180° to 220° C. for 4 hours until a calculated quantity of water was distilled off, thereafter distilling off xylene, decolorizing the residue with white clay and filtering off the white clay to obtain the objective reaction product (Sample No. J) (680 g).

Preparation example 6 (a compound of the formula (V))

In the same manner as in Preparation example 3, into a four-necked flask were fed dimer acid (Haridimer 300; tradename of product made by Harima Kasei Company) (one mol) and triethylenetetramine (2 mols), followed by reacting these materials under xylene solvent reflux at 180° to 260° C. until a calculated quantity of water was distilled off. The time required therefor was 7 hours. Beef tallow fatty acids (1.9 mol) were then fed, followed by carrying out reaction at 180° to 230° C. for 3 hours until a calculated water was distilled off, successively distilling off xylene, decolorizing the residue with white clay and filtering off the white clay to obtain the objective reaction product (Sample No. M) (830 g). Similarly, imidazoline synthetic esters and imidazoline acid amides were prepared. The formers are shown in Table 2 and 3 and the latters are shown in Tables 4 and 5.

TABLE 2

Imidazoline esters of the formula (II)

| Sample No. | $R_1$ | $R_2$ | Hue (G) | Viscosity (cps/ 50° C.) | Total amine value |
|---|---|---|---|---|---|
| E | Coconut oil fatty acid alkyl residual group | Same as the left | 6 | 85 | 98 |
| F | Isostearic acid alkyl residual | Same as the left | 5 | 118 | 79 |

TABLE 2-continued

| Imidazoline esters of the formula (II) | | | | | |
|---|---|---|---|---|---|
| Sample No. | $R_1$ | $R_2$ | Hue (G) | Viscosity (cps/ 50° C.) | Total amine value |
| | group | | | | |
| G | Phenyl | Oleic acid alkyl residual group | 9 | 104 | 106 |

TABLE 3

| Imidazoline esters of the formula (III) | | | | | |
|---|---|---|---|---|---|
| Sample No. | $R_1$ | $R_2$ | Hue (G) | Viscosity (cps/ 50° C.) | Total amine value |
| H | Adipic acid alkyl residual group | Oleic acid alkyl residual group | 7 | 172 | 112 |
| I | Dodecanedionic acid alkyl residual group | Fish oil-hydrogenated fatty acid alkyl residual group | 4 | 229 | 97 |

TABLE 4

| Imidazoline acid amide compounds of the formula (IV) | | | | | | |
|---|---|---|---|---|---|---|
| Sample No. | $R_1$ | $R_2$ | n | Hue (G) | Viscosity (cps/ 50° C.) | Total amine value |
| J | Isostearic acid alkyl residual group | Benzoic acid alkyl residual group | 1 | 8 | 197 | 105 |
| K | Tall oil fatty acid alkyl residual group | Same as the left | 1 | 7 | 181 | 80 |
| L | Castor oil fatty acid alkyl residual group | Same as the left | 3 | 8 | 295 | 176 |

TABLE 5

| Imidazoline acid amide compounds of the formula (V) | | | | | | |
|---|---|---|---|---|---|---|
| Sample No. | $R_1$ | $R_2$ | n | Hue (G) | Viscosity (cps/ 50° C.) | Total amine value |
| M | Dimer acid alkyl residual group | Beef tallow fatty acid alkyl residual group | 2 | 9 | 380 | 141 |
| N | Phthalic acid alkyl residual group | Soybean oil fatty acid alkyl residual group | 1 | 8 | 215 | 118 |

EXAMPLE 1

Test directed to general specific features in the metal plastic processing

The test results of the properties of the lubricating oil of the present invention were compared with those of conventional lubricating oils and these results are shown in Table 6.

The coefficient of friction and anti-seizing properties were measured by means of Bowden tester and the heat resistance was measured by means of a thermobalance.

Test by means of Bowden tester

The surface of a low carbon steel sheet was coated with various sample lubricants and the coated surface was pressed by a steel ball of 3/16 inch diameter under a load of 3 kg (hertz pressure: 223 kg/mm$^2$) and the ball was slided in reciprocating manner at a rate of 4 mm/sec to measure the number of times of sliding (anti-seizing properties) at which the coefficient of friction of the coated lubricants reached 0.15.

Test by means of thermobalance

A sample lubricant (35 mg) was placed in a platinum crucible, followed by gradually heating it at a rate of 5° C. each minute in He atmosphere and measuring the heating temperature at which the sample lubricant decomposed and burnt off.

In the Bowden test, the test was carried out under plastic processing conditions of steel sheet as close to the actual ones as possible; the test temperature was made 200° C. taking into account the heat generation due to plastic deformation; and as the steel sheet, a mild steel sheet which easily caused plastic deformation was used.

The coefficient of friction corresponds to the power required at the time of actual processing and the anti-seizing properties correspond to the occurrence of seizing marks and the life of tool.

Further, in the test by means of thermobalance, it can be said that the higher the temperature at which the sample lubricant burns off, the better the heat resistance.

EXAMPLE 2

Rolling lubricating oil

With a mineral oil or palm oil usually used as a base oil for practical rolling oils were blended an emulsifier, a fatty acid and an oxidant, usually used as additives and the synthetic ester of the present invention to prepare rolling oils, and lubricating properties and annealing properties of the oils were evaluated.

An emulsion rolling was carried out be means of a two-stage roll type rolling machine, with a rolling material (spcc) (1.2×20×200 mm) and under condition of an oil matter concentration of 3% and a bath temperature of 50° C., and a rolling load at a draft of 40% was measured to evaluate the rolling lubricating properties. Further, as to the annealing properties, a steel sheet rolled with a sample emulsion was heaped up, as it was, in a number of several tens sheets, followed by fixing these sheets with a steel band having a small width and annealing them in a small type annealing oven.

As to the heating condition at the time of the annealing, the steel sheets was heated up to 600° C. in an atmosphere of HNX gas ($H_2$: 5%) at a rate of 120 ml/min. and at a temperature-raising rate of 10° C./min., followed by keeping the temperature at 600° C. for one hour, then allowing it to cool down, thereafter applying a cellophane tape onto the steel surface to collect the matter attached thereonto, applying the resulting tape onto a white paper and judging the extent of stains visually to evaluate the surface cleanability of the steel sheet. The test results are collectively shown in Table 7.

EXAMPLE 3

Cutting oil

The results of the durability test, four-ball friction test for lubricant and α-model lubricating property test of a cutting oil having the substance of the present invention blended therein (Sample Nos. 1–4) are shown in Table 8. Sample Nos. 5 and 6 each show a commercially available cutting oil.

TABLE 6

| | Sample lubricant | | | Test results | | |
|---|---|---|---|---|---|---|
| | Sample No. 1* | Blended amount (%) | other blended agents | Coefficient of friction | Anti-seizing property (frequencies) | Heat resistance (°C.) |
| Lubricating oil of the present invention | A | 100 | | 0.050 | 84 | 470 |
| | B | 100 | | 0.055 | 82 | 420 |
| | C | 100 | | 0.045 | 89 | 500 |
| | D | 100 | | 0.055 | 78 | 450 |
| | A | 30 | Machine oil 65%<br>Stearine oil 5% | 0.065 | 70 | 415 |
| | C | 10 | Beef tallow 30%, Machine oil 55%<br>Nonionic surfactant 5% | 0.060 | 75 | 430 |
| | D | 30 | Machine oil 25%, Beef tallow 25%<br>Octyl stearate 15%<br>Nonionic surfactant 5% | 0.065 | 66 | 420 |
| Conventional lubricating oil | | | Machine oil 100% | 0.120 | 4 | 355 |
| | | | Stearic acid 100% | 0.070 | 11 | 360 |
| | | | Beef tallow 100% | 0.065 | 26 | 430 |
| | | | Machine oil 35%, Beef tallow 35%<br>Octyl stearate 30% | 0.080 | 29 | 400 |

*Nos. A–D each indicate the same ester component as those of Samples Nos. in Table 1.

TABLE 7

| | | Emulsion[5] | | | | |
|---|---|---|---|---|---|---|
| | | Comp. ex. 1 | Synthetic ester (content: 45%) | | | |
| | | | Sample No. A | Sample No. B | Sample No. C | Sample No. D |
| Composition of rolling oil* | Mineral oil | 55 | 50.5 | 50 | 50 | 50.5 |
| | Purified Oil and fat | 40 | — | — | — | — |
| | Palmitic acid | 2.5 | 2.5 | 2.5 | 2.5 | 2.5 |
| | Antioxidant[1] | 1 | 1 | 1 | 1 | 1 |
| | Emulsifier[2] | 1.5 | 1 | 1.5 | 1.5 | 1 |
| Ratio of rolling loads[3] (lubricating properties) | | 1.00 | 0.95 | 0.97 | 0.93 | 0.96 |
| Annealing properties[4] | | x~Δ | ◎~○ | ◎~○ | ◎~Δ | ◎~○ |

*Composition of rolling oil wt. %
[1]Antioxidant, 2,6-tert-butyl-4-methylphenol
[2]Emulsifier, polyoxyethylenenonylphenylether (HLB 11.5)
[3]Ratio of rolling loads, value based on Comparative ex. 1
[4]Evaluation of the surface cleanability of steel sheet
◎ Stain occurrence, none
○ Stain occurrence, very slight
Δ Stain occurrence, apparent
x Stain occurrence, much
[5]Practically used emulsion, oil content 3%
Nos. A~D each indicate the same ester content as those of the Nos. in Table 1.

TABLE 8

| Sample No. | Blending (%) | | Durablity[1] Test | Compressive[2] strength ($kg/cm^2$) | Seizing[3] load (kg) | Attrition[3] width (mm) |
|---|---|---|---|---|---|---|
| 1 | Sample No. A | 40% | Unchanged, flowable | >22 | >315 | 2.8 |
| | Liquid paraffin | 60% | | | | |
| 2 | Sample No. B | 55% | Unchanged, flowable | >20 | >315 | 2.9 |
| | Liquid paraffin | 40% | | | | |
| | Coconut oil | 5% | | | | |
| 3 | Sample No. C | 40% | Unchanged, flowable | >25 | >315 | 2.5 |
| | Liquid paraffin | 60% | | | | |
| 4 | Sample No. D | 60% | Unchanged, flowable | >23 | >315 | 2.7 |
| | Liquid paraffin | 40% | | | | |
| 5 | Commercially available general-purpose product | | Cured into varnish form | 5 | 160 | 5 |
| | Spindle oil | 90% | | | | |
| | Fatty oil content | 10% | | | | |
| 6 | Commercially available general-purpose product | | Discolored into black-brown, flowable | 15 | >315 | 3.5 |
| | Spindle oil | 93% | | | | |
| | Fatty oil content | 5% | | | | |

TABLE 8-continued

| Sample No. | Blending (%) | Durablity[1] Test | Compressive[2] strength (kg/cm²) | Seizing[3] load (kg) | Attrition[3] width (mm) |
|---|---|---|---|---|---|
| | Chlorine content | 2% | | | |

Note
[1]Cold-rolled steel sheet was dipped in a sample oil, followed by pulling up the sheet, allowing it to still stand horizontally at an indoor place near a window where no direct sunlight is shined and observing the condition of the steel.
[2]Using a soda-type four-ball tester according to JIS K2519 and applying a series of loads each at a rate of 0.5 kg/cm² per minute at 220 rpm, the lubricating properties of a cutting oil according to the present invention were compared with those of a commercially available cutting oil.
[3]Using an -model LFW-type tester according to ASTM D2714, a series of loads each at a rate of 15 kg/min. were applied up to 315 kg onto a test piece at 300 rpm at 110° F., and the attrition width and seizing load of the resulting piece were measured.

EXAMPLE 4

Aqueous cutting oil

Aqueous cutting oils (Sample Nos. 7–10) having the substances of the present invention blended therein were prepared and these oils were each diluted with sterilized water into 5% by weight to prepare testing solution, which are shown in Table 9.

Using these testing solution shown in Table 9, tests shown in Table 10 were carried out.

TABLE 9

| Sample No. | Substance of the present invention | | Mineral oil | Chlorinated paraffin | Anionic surfactant | Nonionic surfactant | Antiseptic (Triazine compound) |
|---|---|---|---|---|---|---|---|
| | | Blending example (%) | | | | | |
| 7 | Sample No. A | 40 | 30 | 10 | 14 | 5 | 1 |
| 8 | Sample No. B | 50 | 30 | — | 15 | 5 | — |
| 9 | Sample No. C | 30 | 50 | 5 | 9 | 5 | 1 |
| 10 | Sample No. D | 50 | 40 | 5 | — | 5 | — |
| 11 | — | | 55 | 15 | 23 | 5 | 2 |

TABLE 10

| Measurement item | Blending sample No. 7 | 8 | 9 | 10 | 11 |
|---|---|---|---|---|---|
| Appearance change[1] | ○ | ○ | ○ | ○ | Δ |
| Smell[2] | ○ | ○ | ○ | ○ | Δ |
| pH | 8.6 | 9.2 | 9.0 | 9.1 | 9.0 |
| Number of fungi/ml[3] | 10 or less | 10 or less | 10 or less | 10 or less | $5 \times 10^2$ |
| Rust proof properties (24 h)[4] | ◎ | ◎ | ◎ | ◎ | Δ |
| Coefficient of friction[5] | 0.16 | 0.14 | 0.20 | -0.13 | 0.25 |
| Compressive strength (kg)[6] | 16.5 | 16.0 | 15.5 | 18.0 | 10.0 |

EXAMPLE 5

Using the lubricating oils of the present invention (Sample Nos. E-N in Tables 2–5), tests directed to specific features in metal plastic processing were carried out in the same manner as in Example 1. The results are shown in Table 11.

EXAMPLE 6

Rolling lubricating oil

Using the synthetic esters of the present invention (Sample Nos. E, F, I, J, L and M), rolling oil emulsions having compositions as indicated in Table 12 were prepared and rolling lubricating properties and annealing properties were tested in the same manner as in Example 2. The results are shown in Table 12.

EXAMPLE 7

Cutting rolling oil

The durability tests, four-ball lubricating properties tests and α-model lubricating properties tests of the cutting oils (Sample Nos. 1–4) having the substances of the present invention blended therein were carried out. The results are shown in Table 13. Sample Nos. 5 and 6 indicates commercially available cutting oils.

EXAMPLE 8

Aqueous cutting oil

As shown in Table 14, aqueous cutting oils (Sample Nos. 7–11) having the substances of the present invention blended therein were prepared, followed by diluting the oils into 5% by weight to prepare testing solutions. Sample No. 12 shows comparative example.

Using the blending examples shown in Table 14, tests shown in Table 15 were carried out.

TABLE 11

| Sample lubricant: Sample No.* | Blended amount | Other blending agents | | Test results: Co-efficient of friction | Anti-seizing properties (°C.) | Heat resistance (%) |
|---|---|---|---|---|---|---|
| Lubricating oils of the present invention | | | | | | |
| E | 100 | | | 0.055 | 77 | 450 |
| F | 100 | | | 0.050 | 80 | 460 |
| G | 100 | | | 0.055 | 78 | 445 |
| H | 100 | | | 0.045 | 86 | 470 |
| I | 100 | | | 0.040 | 88 | 500 |
| J | 100 | | | 0.050 | 80 | 455 |
| K | 100 | | | 0.050 | 82 | 445 |
| L | 100 | | | 0.050 | 80 | 465 |
| M | 100 | | | 0.030 | 92 | 470 |
| N | 100 | | | 0.040 | 88 | 460 |
| E | 30 | Machine oil | 65% | 0.065 | 66 | 420 |
| | | Stearic acid | 5% | | | |
| F | 10 | Beef tallow | 30% | 0.060 | 70 | 425 |

TABLE 11-continued

| Sample lubricant | | | | Test results | | |
|---|---|---|---|---|---|---|
| Sample No.* | Blended amount | Other blending agents | | Co-efficient of friction | Anti-seizing properties (°C.) | Heat resistance (%) |
| | | Machine oil | 55% | | | |
| | | Nonionic surfactant | 5% | | | |
| H | 30 | Machine oil | 25% | 0.055 | 75 | 430 |
| | | Beef tallow | 25% | | | |
| | | Octyl stearate | 15% | | | |
| | | Nonionic surfactant | 5% | | | |
| Conventional lubricating oil | | | | | | |

TABLE 11-continued

| Sample lubricant | | | | Test results | | |
|---|---|---|---|---|---|---|
| Sample No.* | Blended amount | Other blending agents | | Co-efficient of friction | Anti-seizing properties (°C.) | Heat resistance (%) |
| | | Machine oil | 100% | 0.120 | 4 | 355 |
| | | Stearic acid | 100% | 0.070 | 11 | 360 |
| | | Beef tallow | 100% | 0.065 | 26 | 430 |
| | | Machine oil | 35% | 0.080 | 29 | 400 |
| | | Beef tallow | 35% | | | |
| | | Octyl stearate | 30% | | | |

*Nos. E–N indicate the same ester components as those of Sample Nos. in Tables 2–5.

TABLE 12

| | | Emulsion[5] | | | | | | |
|---|---|---|---|---|---|---|---|---|
| | | | Synthetic ester (content: 45%) | | | | | |
| | | Comp. ex. 1 | Sample No. E | Sample No. F | Sample No. I | Sample No. J | Sample No. L | Sample No. M |
| Composition of rolling oil* | Mineral oil | 55 | 50 | 50.5 | 50 | 50 | 50 | 50.5 |
| | Purified oil and fat | 40 | — | — | — | — | — | — |
| | Palmitic acid | 2.5 | 2.5 | 2.5 | 2.5 | 2.5 | 2.5 | 2.5 |
| | Antioxidant[1] | 1 | 1 | 1 | 1 | 1 | 1 | 1 |
| | Emulsifier[2] | 1.5 | 1.5 | 1 | 1.5 | 1.5 | 1.5 | 1 |
| Ratio of rolling loads[3] (lubricating properties) | | 1.00 | 0.96 | 0.95 | 0.93 | 0.94 | 0.92 | 0.92 |
| Annealing properties[4] | | x~Δ | ◎~○ | ◎~○ | ◎~○ | ◎~○ | ○ | ○ |

*Composition of rolling oil wt. %
[1]Antioxidant, 2,6-tert-butyl-4-methylphenol
[2]Emulsifier, polyoxyethylenenonylphenylether (HLB 11.5)
[3]Ratio of rolling loads, value based on Comparative example 1
[4]Evaluation of the surface cleanability of steel sheet
◎ Stain occurrence, none
○ Stain occurrence, very slight
Δ Stain occurrence, apparent
x Stain occurrence, much
[5]Practically used emulsion, oil content 3%

TABLE 13

| Sample No. | Blending (%) | | Durability[1] test | Compressive strength (kg/cm$^2$) | Seizing[3] load (kg) | Attrition[3] width (mm) |
|---|---|---|---|---|---|---|
| 1 | Sample No. A | 40% | Unchanged, | >22 | >315 | 2.9 |
| | Liquid paraffin | 60% | Flowable | | | |
| 2 | Sample No. D | 55% | Unchanged | >26 | >315 | 2.6 |
| | Liquid paraffin | 40% | Flowable | | | |
| | Coconut oil | 5% | | | | |
| 3 | Sample No. H | 40% | Unchanged, | >24 | >315 | 2.7 |
| | Liquid paraffin | 60% | Flowable | | | |
| 4 | Sample No. J | 60% | Unchanged, | >25 | >315 | 2.6 |
| | Liquid paraffin | 40% | Flowable | | | |
| 5 | Commercially available general-purpose product | | Cured into varnish form | 5 | 160 | 5 |
| | Spindle oil | 90% | | | | |
| | Fatty oil content | 10% | | | | |
| 6 | Commercially available general-purpose product | | Discolored into black-brown, | 15 | >315 | 3.5 |
| | Spindle oil | 93% | Flowable | | | |
| | Fatty oil content | 5% | | | | |
| | Chlorine content | 2% | | | | |

Note
[1]Cold-rolled steel sheet was dipped in a sample oil, followed by pulling up it, allowing it to stand still horizontally at an indoor place near a window where direct sunlight is not shined, and observing its condition.
[2]Using a Soda-type four-ball tester according to JIS KL519 and applying loads each at a rate of 0.5 kg/cm$^2$ per min. at 220 rpm, the lubricating properties of the cutting oils of the present invention were compared with those of commercially available cutting oil.
[3]Using an α-model LFW-1 type tester according to ASTM D2714, and applying loads each at a rate of 15 kg/min. at 300 rpm and at 110° C. up to 315 kg, the attrition width of the resulting test piece and the seizing load were measured.

TABLE 14

| Sample No. | Substance of the present invention | | Blending example (%) Mineral oil | Chlorinated paraffin | Anionic surfactant | Nonionic surfactant | Antiseptic (triazine compound) |
|---|---|---|---|---|---|---|---|
| 7 | Sample No. E | 40 | 30 | 10 | 14 | 5 | 1 |
| 8 | Sample No. G | 50 | 30 | — | 15 | 5 | — |
| 9 | Sample No. I | 30 | 50 | 5 | 9 | 5 | 1 |
| 10 | Sample No. M | 50 | 40 | 5 | — | 5 | — |
| 11 | Sample No. N | 40 | 40 | 14 | — | 5 | 1 |
| 12 | — | | 55 | 15 | 23 | 5 | 2 |

TABLE 15

| Measurement item | Blending sample No. 7 | 8 | 9 | 10 | 11 | 12 |
|---|---|---|---|---|---|---|
| Change in appearance[1] | ○ | ○ | ○ | ○ | ○ | Δ |
| Smell[2] | ○ | ○ | ○ | ○ | ○ | Δ |
| pH | 9.1 | 9.2 | 9.1 | 9.0 | 9.2 | 9.0 |
| Number of fungi/ml[3] | 10 or less | 10 or less | 10 or less | 10 or less | 10 or less | $5 \times 10^2$ |
| Rust proof properties (24 h)[4] | ◎ | ◎ | ◎ | ◎ | ◎ | Δ |
| Coefficient of friction[5] | 0.15 | 0.16 | 0.18 | 0.12 | 0.13 | 0.25 |
| Compressive strength | 16.5 | 16.5 | 16.0 | 18.0 | 18.5 | 10.0 |

Note [1] to [6] in Table 15 are as described in Table 10.

The synthetic ester compounds of the present invention prepared from a nitrogen-containing polyol and a fatty acid are far superior in the aspect of lubricating properties and stability to conventional lubricating oils, and usable as lubricating oils for various industries such as rolling oils, hydraulic fluids, cutting-grinding oils, lubricating oils for metal plastic processing, lubricating oils for internal engines, spinning lubricant for synthetic fibers, etc.

For example, the rolling oils composed of the synthetic ester compounds of the present invention more improve the rolling lubricating properties of steel sheets as compared with cold rolling oils using existing synthetic esters; hence energy saving such as reduction in the power cost and resources-saving effect are brought about. Further, the oils are also superior in the annealing properties, can omit conventional electrolytic degreasing and can reduce equipment cost.

Further, the synthetic ester compounds can constitute a high performance lubricant which has superior lubricating properties at the time of cutting or grinding and also can sufficiently satisfy various use conditions such as smell, stability, etc.

Further, at the time of processing lubrication, sufficient lubrication is ensured even under severe conditions such as high-speed processing and it is possible to make the processing smooth and efficient.

Furthermore, it is possible to prevent the quality reduction of products which occurs due to lubricating insufficiency such as seizing marks; attrition or breakage of tools is prevented; the quality of products in enhanced; and the life of tools is notably prolonged.

Further, many superior effects are brought about such as reduction in the power required at the time of processing, more promotion of resources saving, energy saving, etc.

What we claim is:

1. A lubricating oil comprising from 99 weight percent to 1 weight percent of a base oil and from 1 weight percent to 99 weight percent of at least one member selected from the group consisting of compounds expressed by the following formulas I, II, III, IV or V:

I

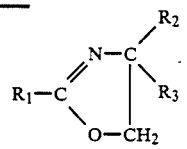

wherein $R_1$ represents an alkyl group, an alkenyl group, a hydroxyalkyl group, a hydroxyalkenyl group, each of 5 or more carbon atoms or a phenyl group; $R_2$ and $R_3$ each represent $CH_2OCOR_1$, $CH_2OH$ or H wherein $R_1$ is as defined above:

II

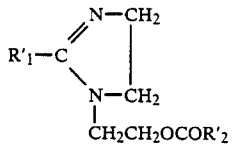

III

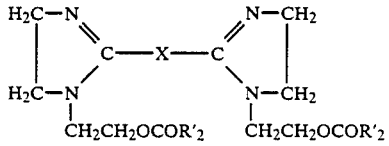

IV

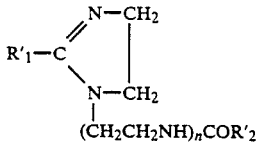

V

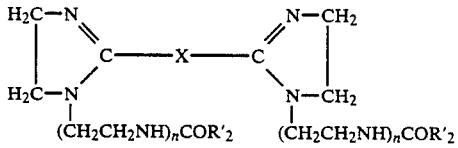

wherein $R'_1$ and $R'_2$ each represent an alkyl group, an alkenyl group, a hydroxyalkyl group, a hydroxyalkenyl group each of 5 or more carbon atoms or a phenyl group; n represents an integer of 1 to 3; and X represents an alkyl group, an alkenyl group, each of 2 to 34 carbon atoms or a phenyl group.

2. A lubricating oil according to claim 1 wherein said lubricating oil is a cold rolling oil used in the form of emulsion.

* * * * *